US011925256B2

(12) United States Patent
Leng

(10) Patent No.: US 11,925,256 B2
(45) Date of Patent: Mar. 12, 2024

(54) FOLDABLE TABLE

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 17/901,339

(22) Filed: Sep. 1, 2022

(65) Prior Publication Data

US 2023/0240440 A1 Aug. 3, 2023

(30) Foreign Application Priority Data

Jan. 28, 2022 (CN) ..... 202220241364.9
Mar. 1, 2022 (CN) ..... 202220440114.8

(51) Int. Cl.
*A47B 3/00* (2006.01)
*A47B 3/08* (2006.01)
*A47B 21/02* (2006.01)

(52) U.S. Cl.
CPC ..... *A47B 3/002* (2013.01); *A47B 3/0809* (2013.01); *A47B 21/02* (2013.01)

(58) Field of Classification Search
CPC .. A47B 3/00; A47B 3/002; A47B 3/08; A47B 3/0809; A47B 2003/0827; A47B 2003/0824; A47B 21/02
USPC ..... 108/132, 26
See application file for complete search history.

(56) References Cited

U.S. PATENT DOCUMENTS 348,706 A * 9/1886 Weiner ..... A47B 19/08 297/440.22
1,423,612 A * 7/1922 Jewett ..... A47J 33/00 126/30
1,579,823 A * 4/1926 Langguth ..... A47C 9/022 312/246
1,962,575 A * 6/1934 Sllverman ..... A24F 19/0092 108/26
2,457,285 A * 12/1948 Stopner ..... A61G 15/10 108/26
2,703,266 A * 3/1955 Henschel ..... A47B 13/16 108/26
2,926,794 A * 3/1960 Karoff ..... A47B 13/16 108/26
2,982,420 A * 5/1961 Wannemacher ... A47G 23/0633 211/74
3,089,438 A * 5/1963 Paradise ..... A47B 35/00 108/26

(Continued)

*Primary Examiner* — Jose V Chen
(74) *Attorney, Agent, or Firm* — Cooper Legal Group LLC

(57) ABSTRACT

The present disclosure discloses a foldable table comprising a table board and a foot supporting frame. A rear portion of a bottom surface of the table board is rotatably connected to a top portion of the foot supporting frame. The foot supporting frame comprises two supporting rods disposed symmetrically on a left side and a right side of the foldable table and a U-shaped fixed rod. Lower ends of the two supporting rods are respectively rotatably connected to two ends of an opening of the U-shaped fixed rod. When the table board and the foot supporting frame are opened to be in an opened state, the U-shaped fixed rod is supported on ground with the opening of the U-shaped fixed rod facing forward, the two supporting rods are disposed obliquely with respect to the ground, and a side view of the folding table is Z-shaped.

12 Claims, 14 Drawing Sheets

(56) References Cited

U.S. PATENT DOCUMENTS

| | | | | | |
|---|---|---|---|---|---|
| 5,295,650 | A * | 3/1994 | Brandt | A47C 7/68 | 108/26 |
| 5,435,620 | A * | 7/1995 | Cheng | A47C 4/20 | 297/51 |
| 5,542,360 | A * | 8/1996 | Fleming | A47B 23/04 | 108/26 |
| 5,771,815 | A * | 6/1998 | Leftwich | A47B 31/06 | 108/115 |
| 6,019,050 | A * | 2/2000 | Ranta | A47B 9/14 | 108/115 |
| 7,086,632 | B2 * | 8/2006 | Hsieh | G10H 1/32 | 248/163.1 |
| 8,726,814 | B1 * | 5/2014 | Matteo | A47B 9/16 | 248/292.12 |
| D859,044 | S * | 9/2019 | Ferentinos | D6/708.16 | |
| 10,617,207 | B2 * | 4/2020 | Hsiao | A47B 85/06 | |
| 2003/0056699 | A1 * | 3/2003 | Malizia | A47C 9/10 | 108/115 |
| 2006/0090675 | A1 * | 5/2006 | Mangano | A47B 3/002 | 108/115 |
| 2008/0017082 | A1 * | 1/2008 | Bue | A47B 3/00 | 108/115 |
| 2008/0041683 | A1 * | 2/2008 | Dorquez | A45C 9/00 | 190/11 |
| 2016/0135589 | A1 * | 5/2016 | Leng | A47B 9/20 | 108/6 |
| 2017/0273451 | A1 * | 9/2017 | Jeanphilippe | F21V 33/0012 | |
| 2021/0068531 | A1 * | 3/2021 | Tao | A47B 27/02 | |
| 2021/0267361 | A1 * | 9/2021 | Leng | A47B 19/06 | |

* cited by examiner

FOLDABLE TABLE

RELATED APPLICATIONS

This application claims priority to Chinese patent application number 202220241364.9, filed on Jan. 28, 2022 and Chinese patent application number 202220440114.8, filed on Mar. 1, 2022. Chinese patent application number 202220241364.9 and Chinese patent application number 202220440114.8 are incorporated herein by reference.

FIELD OF THE DISCLOSURE

The present disclosure relates to a foldable table.

BACKGROUND OF THE DISCLOSURE

Although there are many styles of foldable tables, a structure of a table board of the foldable tables is basically unchanged. The main difference lies in a structure of table legs. Some table legs adopt an X-shaped cross structure, some adopt a left-right symmetrical U-shaped structure, and other table legs adopt a T-shaped structure. Obviously, most of the current foldable tables are relatively old-fashioned and not unique enough. When consumers choose to buy, they hope to have more style options, especially more unique styles to choose from.

BRIEF SUMMARY OF THE DISCLOSURE

The present disclosure provides a foldable table to solve the deficiencies in the background.

In order to solve the technical problem, a first technical solution of the present disclosure is as follows.

A foldable table comprises a table board and a foot supporting frame. A rear portion of a bottom surface of the table board is rotatably connected to a top portion of the foot supporting frame. The foot supporting frame comprises two supporting rods disposed symmetrically on a left side and a right side of the foldable table and a U-shaped fixed rod. Lower ends of the two supporting rods are respectively rotatably connected to two ends of an opening of the U-shaped fixed rod. When the table board and the foot supporting frame are opened to be in an opened state, the U-shaped fixed rod is supported on ground with the opening of the U-shaped fixed rod facing forward, the two supporting rods are disposed obliquely with respect to the ground, and a side view of the folding table is Z-shaped.

The table board is rotatably connected to the foot supporting frame, and the table board can be rotated to be in the opened state or a folded state. The two supporting rods are rotatably connected to the two ends of the U-shaped fixed rod, the U-shaped fixed rod can be rotated to be in the opened state or the folded state, and the opening of the U-shaped fixed rod faces forward to be supported on the ground when the U-shaped fixed rod is in the opened state. The two supporting rods are disposed obliquely with respect to the ground, and the table board and the foot supporting frame form a Z-shape, which has the advantage of a unique structure.

In a preferred embodiment, when the table board and the foot supporting frame are opened to be in the opened state, a projection surface of a top view of the table board substantially overlaps with the U-shaped fixed rod. The table board extends forward at the upper ends of the two supporting rods, and the U-shaped fixed rod extends rearward at the lower ends of the two supporting rods.

In a preferred embodiment, when the table board is in a folding process, the table board is rotated downward around a first connection point at which the table board is connected to the foot supporting frame, and the table board is folded on the two supporting rods. When the U-shaped fixed rod is in the folding process, the U-shaped fixed rod is rotated downward around a second connection point at which the U-shaped fixed rod is connected to the two supporting rods, and the U-shaped fixed rod is folded on the two supporting rods or on a top surface of the table board. When the U-shaped fixed rod is folded, the U-shaped fixed rod is rotated downward and then pressed against the two supporting rods or the top surface of table board, and the folding method is novel.

In a preferred embodiment, each of the two ends of the opening of the U-shaped fixed rod is disposed with a position-limiting structure. When the foot supporting frame is opened to be in the opened state, each of the two supporting rods is obliquely disposed on the position-limiting structure with respect to the ground. One or more oblique linking bars are connected between the table board and the two supporting rods. When the table board is opened to be in the opened state, the table board is supported on the one or more oblique linking bars. The position-limiting structure is used to more stably block the two supporting rods, and the oblique linking bar is used to more stably support the table board, so that when the foldable table is opened for use, the force acting on the foldable table is stronger and the stability of the foldable table is better.

In a preferred embodiment, the position-limiting structure is a U-shaped block in which an end portion of each of the two supporting rods is disposed, and the end portion of each of the two supporting rods is rotatably connected to the U-shaped block through a rivet. The U-shaped block can not only surround the end portion of each of the two supporting rods from two sides of each of the two supporting rods to make the connection between the two easier, but also a bottom edge of the U-shaped block can be directly used to inhibit movement of the two supporting rods, which has the advantage of simple structure.

In a preferred embodiment, each of the two ends of the opening of the U-shaped fixed rod is disposed with an outer plastic member, and the outer plastic member is wrapped around the U-shaped block. Each of the lower ends of the two supporting rods is disposed with an inner plastic member, and the outer plastic member is sleeved outside of the inner plastic member. The outer plastic member and the inner plastic member can not only avoid the rigid friction of the metal during the folding process of the foot supporting frame but also can directly act as a plastic foot pad.

In a preferred embodiment, the foldable table further comprises a table foot locking mechanism connected to at least one of the outer plastic members, and the U-shaped fixed rod is locked to the table foot locking mechanism when the U-shaped fixed rod is opened to be in the opened state. When the U-shaped fixed rod is locked to the table foot locking mechanism, the foot supporting frame cannot be folded, and the use safety is good. When the U-shaped fixed rod needs to be folded, the table foot locking mechanism can be released, and the use is convenient.

In a preferred embodiment, the one or more oblique linking bars are two oblique linking bars respectively corresponding to the two supporting rods. An upper end of each of the two oblique linking bars is rotatably connected to a rear portion of a side of the table board, and a lower end of each of the two oblique linking bars is rotatably connected to a sliding sleeve slidably sleeved on each of the two supporting rods. Therefore, the sliding sleeve slides on each of the two supporting rods, and the oblique linking bar is linked with the table board, so that an opening angle of the table board can be adjusted.

In a preferred embodiment, at least one of the sliding sleeves is disposed with a table board locking mechanism, and the at least one of the sliding sleeves is locked to the table board locking mechanism when the table board is opened to be in the opened state. When the sliding sleeve is locked to the table board locking mechanism, the table board cannot swing during use. The foldable table has good bearing capacity and good stability, and when the foldable table needs to be folded, the table board locking mechanism can be unlocked, which is convenient to use.

In a preferred embodiment, the foldable table further comprises a cup holder. A side of the cup holder is disposed with a C-shaped buckle, and the C-shaped buckle is buckled to one of the two supporting rods. The cup holder can be buckled on one of the two supporting rods through the C-shaped buckle and can be removed at any time when not in use, which is convenient to use.

In a preferred embodiment, upper ends of the two supporting rods are connected by a cross rod, and the two supporting rods are telescopic. At least one buckle member is sleeved on the cross rod and is connected to the bottom surface of the table board, and a side wall of the cup holder comprises a hanging groove. The at least one buckle member comprises a hanging lug, and the hanging lug is configured to be locked to the hanging groove. The cup holder can be hung on the at least one buckle member when not in use, which is convenient to use.

In a preferred embodiment, when the table board is in a folding process, the table board is rotated downward around a first connection point at which the table board is connected to the foot supporting frame, and the table board is folded on the two supporting rods. When the U-shaped fixed rod is in the folding process, the two supporting rods are rotated rearward around a second connection point at which the U-shaped fixed rod is connected to the two supporting rods, and the two supporting rods are folded on the U-shaped fixed rod. The table board and the U-shaped fixed rod are respectively folded on an upper side and a lower side of the two supporting rods, so that a thickness of the foldable table is small after being folded.

In a preferred embodiment, each of the two ends of the opening of the U-shaped fixed rod is disposed with an outer hinge, the lower end of each of the two supporting rods is disposed with an inner hinge, and the outer hinge and the inner hinge are rotatably connected to each other through a rivet. An inside of the inner hinge is disposed with one or more position-limiting tooth grooves, an inside of the outer hinge is rotatably connected with a swinging tooth, and the inside of the outer hinge is further disposed with a torsion spring. When the U-shaped fixed rod is opened to be in the opened state, the swinging tooth is disposed in the one or more position-limiting tooth grooves due to an elastic force of the torsion spring so that the two supporting rods are locked to the U-shaped fixed rod. When in use, since the swinging tooth is locked to the one or more position-limiting tooth grooves, the foot supporting frame is in the opened state and has a stable structure.

In a preferred embodiment, the foldable table further comprises a pushing piece rotatably sleeved on the rivet. A first side of the pushing piece facing the swinging tooth comprises a protrusion, and a second side of the pushing piece facing away from the swinging tooth comprises an arc-shaped position-providing groove. The inside of the inner hinge is disposed with a pushing block, and the pushing block is located in the arc-shaped position-providing groove. The two supporting rods are configured to be rotated frontward to drive the pushing block to rotate about the rivet to correspond to a lower end of the arc-shaped position-providing groove to push the pushing piece to rotate together, so that the swinging tooth is pushed away from the one or more position-limiting tooth grooves. The one or more position-limiting tooth grooves are configured to be misaligned with the swinging tooth before the two supporting rods are rotated rearward to drive the pushing block to rotate about the rivet to correspond to an upper end of the arc-shaped position-providing groove. Through the pushing piece and the pushing block on the inner hinge, rotating the two supporting rods can drive the swinging tooth to be separated from the one or more position-limiting tooth grooves, and the unlocking and folding operations are very convenient.

In a preferred embodiment, one or more oblique linking bars are connected between the table board and the two supporting rods. When the table board is opened to be in the opened state, the table board is supported on the one or more oblique linking bars. The one or more oblique linking bars are two oblique linking bars respectively corresponding to the two supporting rods. An upper end of each of the two oblique linking bars is rotatably connected to a rear portion of a side of the table board, and a lower end of each of the two oblique linking bars is rotatably connected to a sliding sleeve slidably sleeved on each of the two supporting rods. At least one of the sliding sleeves is disposed with a table board locking mechanism, and the at least one of the sliding sleeves is locked to the table board locking mechanism when the table board is opened to be in the opened state.

DETAILED DESCRIPTION OF THE EMBODIMENTS

The present disclosure will be further described below in combination with the accompanying drawings and embodiments.

Embodiment 1

Figure 1:
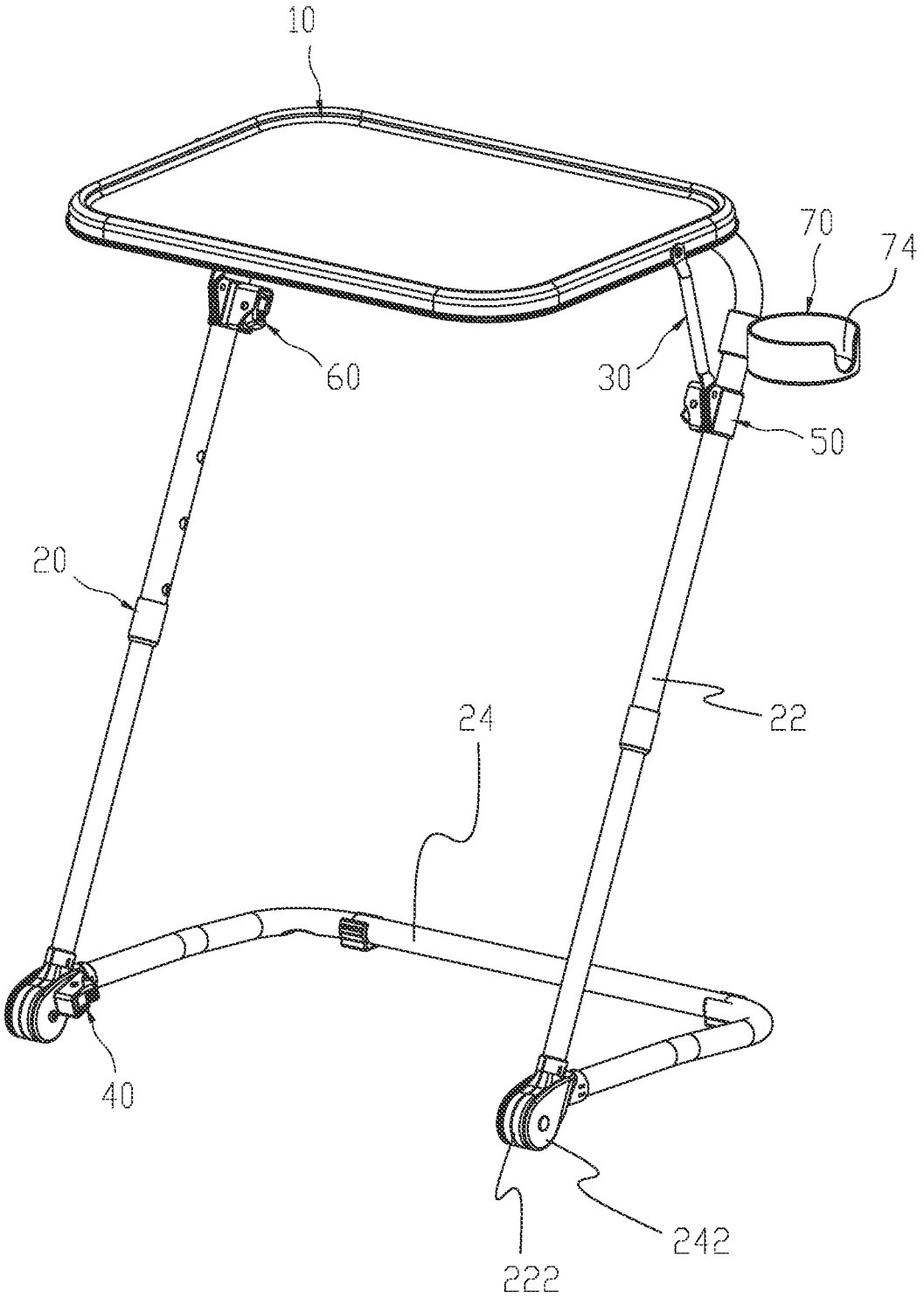
FIG. 1 illustrates a perspective view of a foldable table of Embodiment 1 in the present disclosure, when two supporting rods are in an elongated state and the foldable table is in an opened state.
Figure 2:
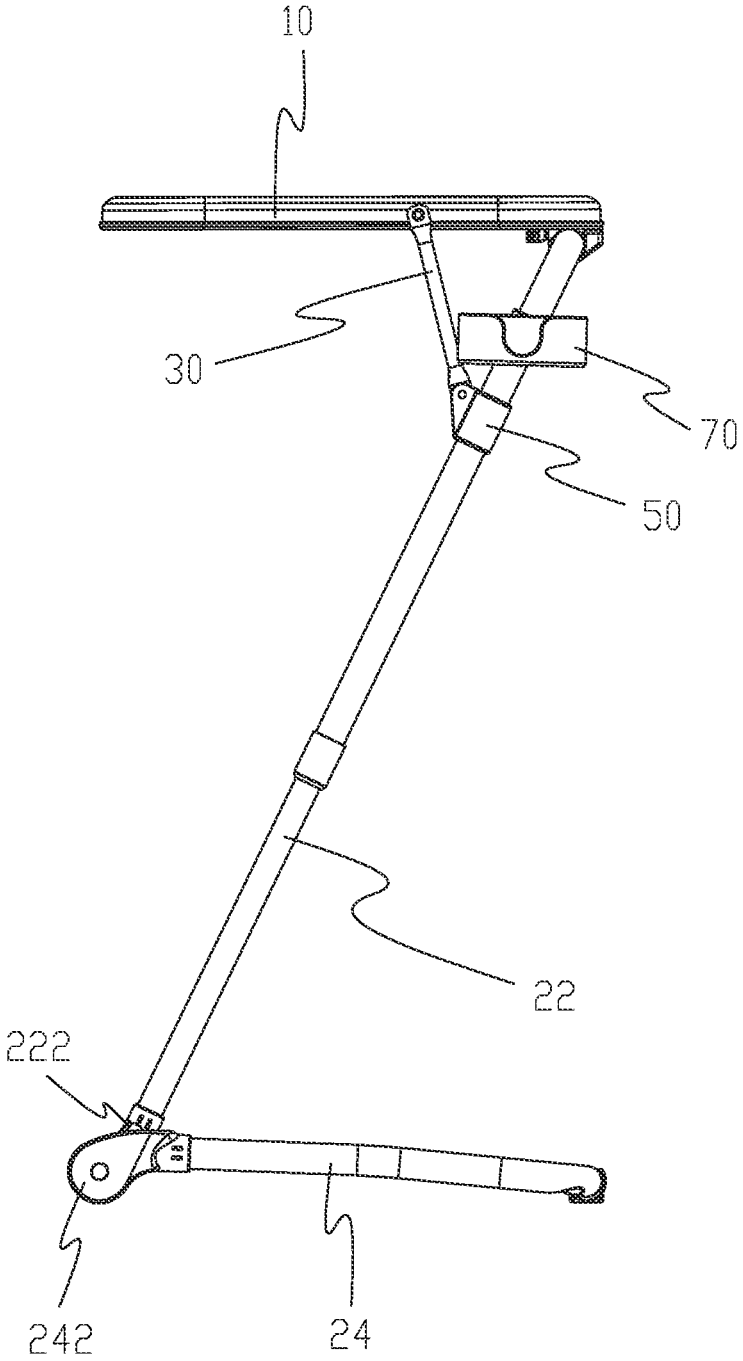
FIG. 2 illustrates a side view of the foldable table illustrated in FIG. 1.

Referring to FIGS. 1 to 10, a foldable table is provided. The foldable table comprises a table board 10 and a foot supporting frame 20, and a rear portion of a bottom surface of the table board 10 is rotatably connected to a top portion of the foot supporting frame 20. The foot supporting frame 20 comprises two supporting rods 22 disposed symmetrically on a left side and a right side of the foldable table and a U-shaped fixed rod 24. Lower ends of the two supporting rods 22 are respectively rotatably connected to two ends of an opening of the U-shaped fixed rod 24. When the table board 10 and the foot supporting frame 20 are opened to be in an opened state, the U-shaped fixed rod 24 is supported on ground with the opening of the U-shaped fixed rod 24 facing forward, the two supporting rods 22 are disposed obliquely with respect to the ground, and a side view of the folding table is Z-shaped, as shown in FIG. 2.

Figure 3:
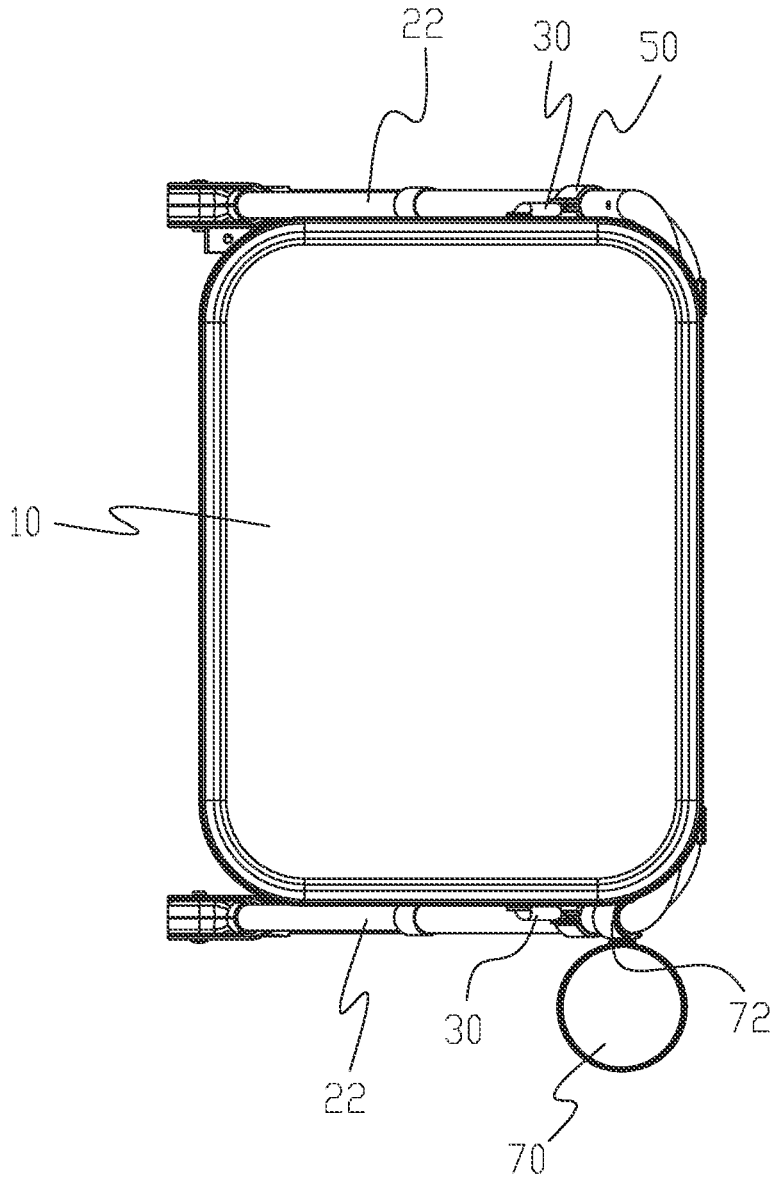
FIG. 3 illustrates a top view of the foldable table illustrated in FIG. 1.
Figure 4:
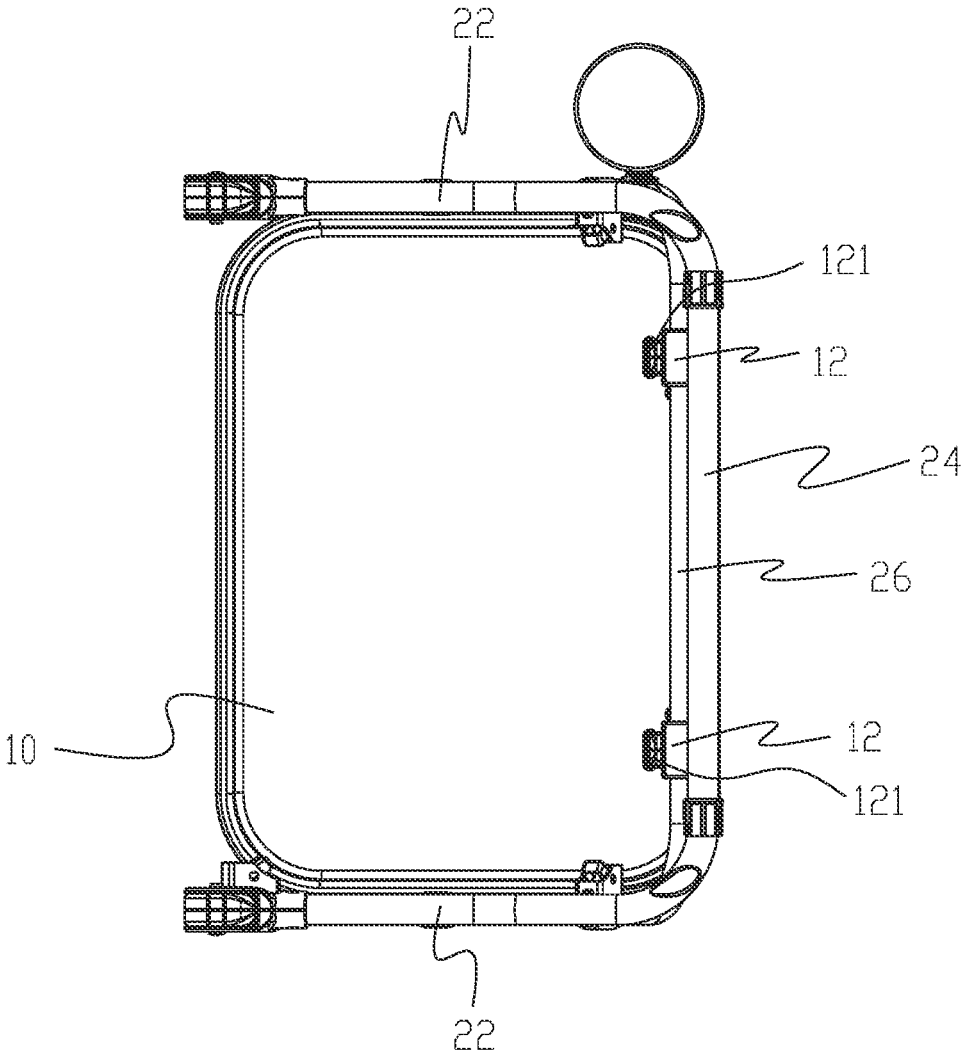
FIG. 4 illustrates a bottom view of the foldable table illustrated in FIG. 1.
Figure 5:
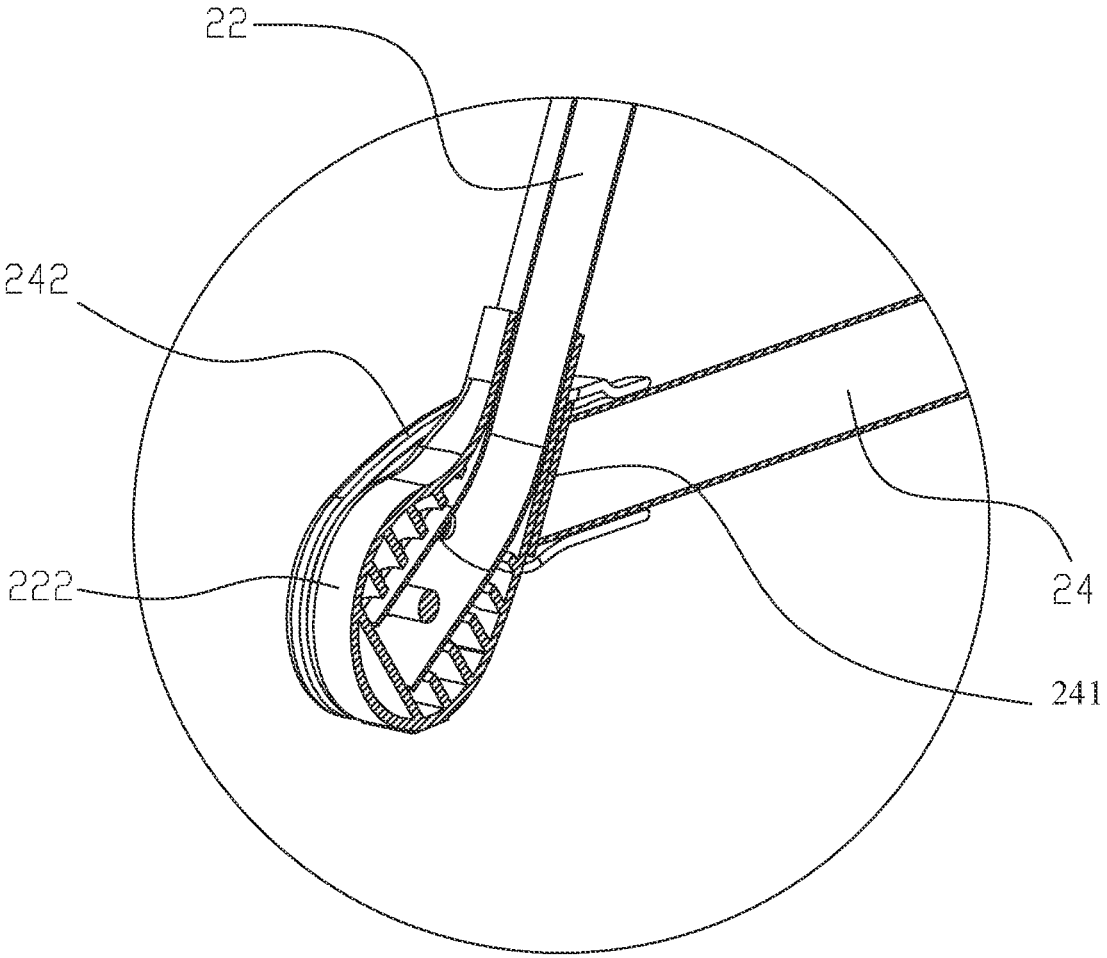
FIG. 5 illustrates a cross-sectional, perspective view of the foldable table illustrated in FIG. 1.
Figure 6:
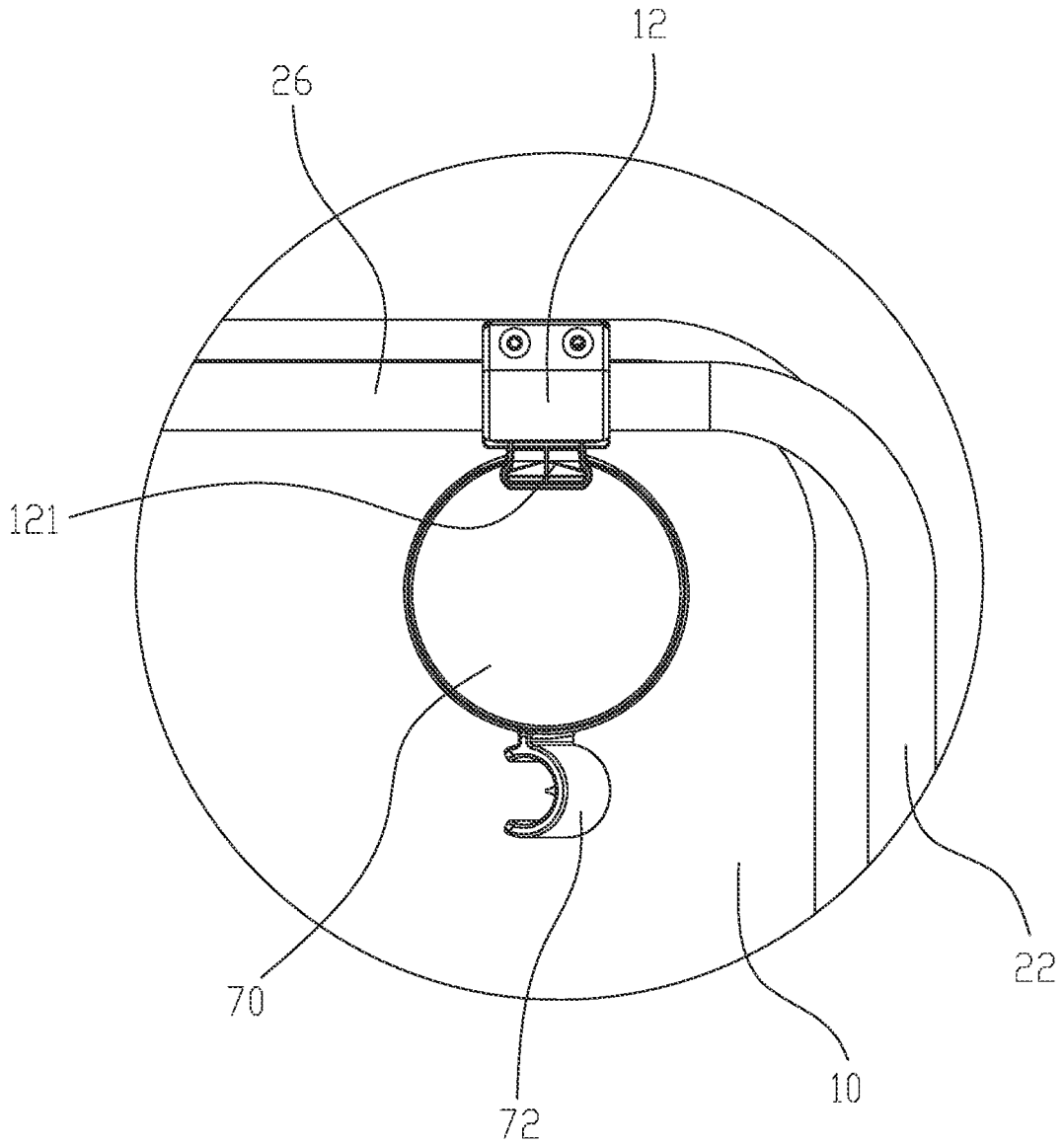
FIG. 6 illustrates a perspective view of the foldable table illustrated in FIG. 1, illustrating a cup holder being connected to a buckle member.

Preferably, when the table board 10 and the foot supporting frame 20 are opened to be in the opened state, a projection surface of a top view of the table board 10 substantially overlaps with the U-shaped fixed rod 24, as shown in FIGS. 3 and 4.

Figure 7:
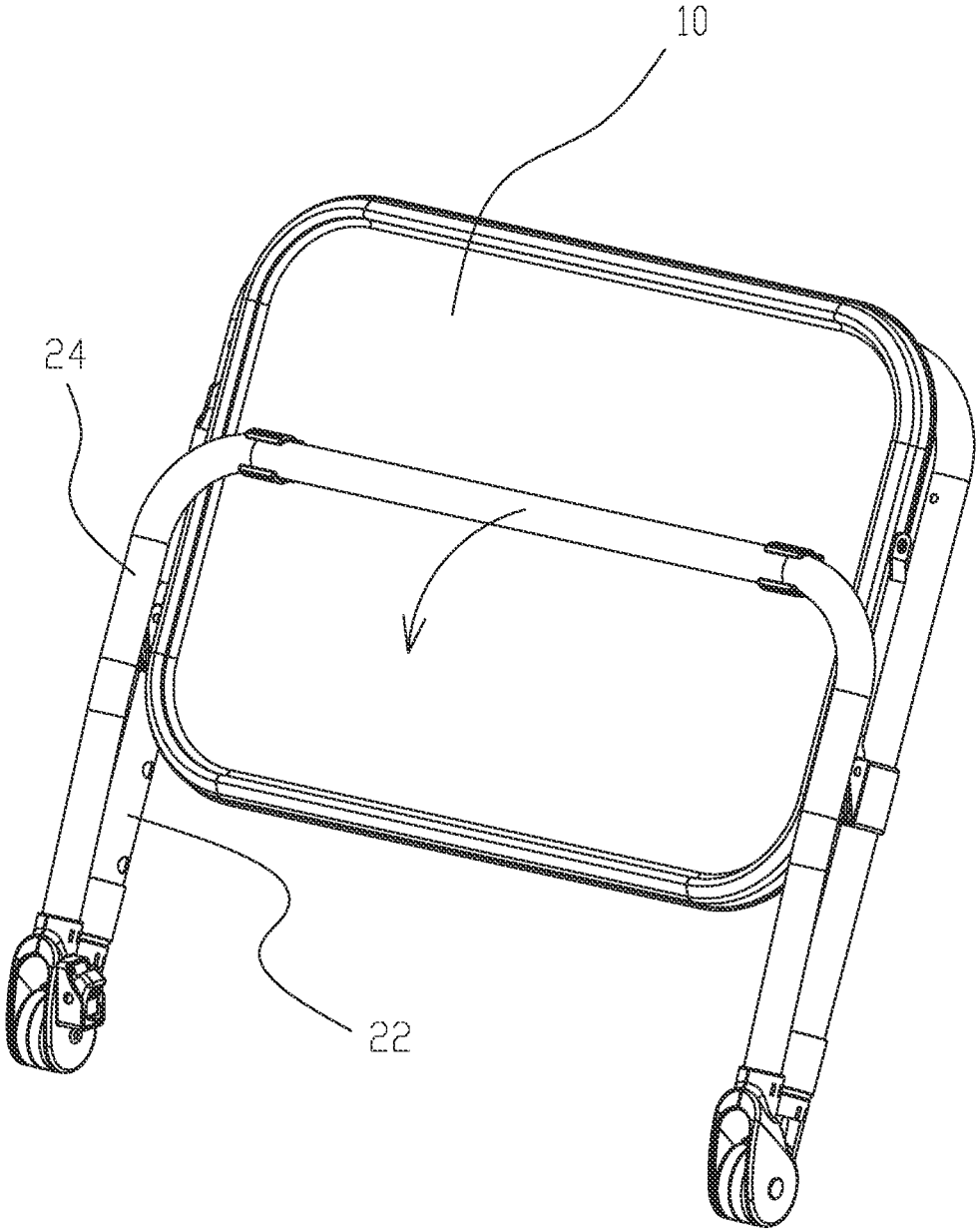
FIG. 7 illustrates a perspective view of the foldable table of Embodiment 1 in the present disclosure, when the foldable table is in a folded state.
Figure 8:
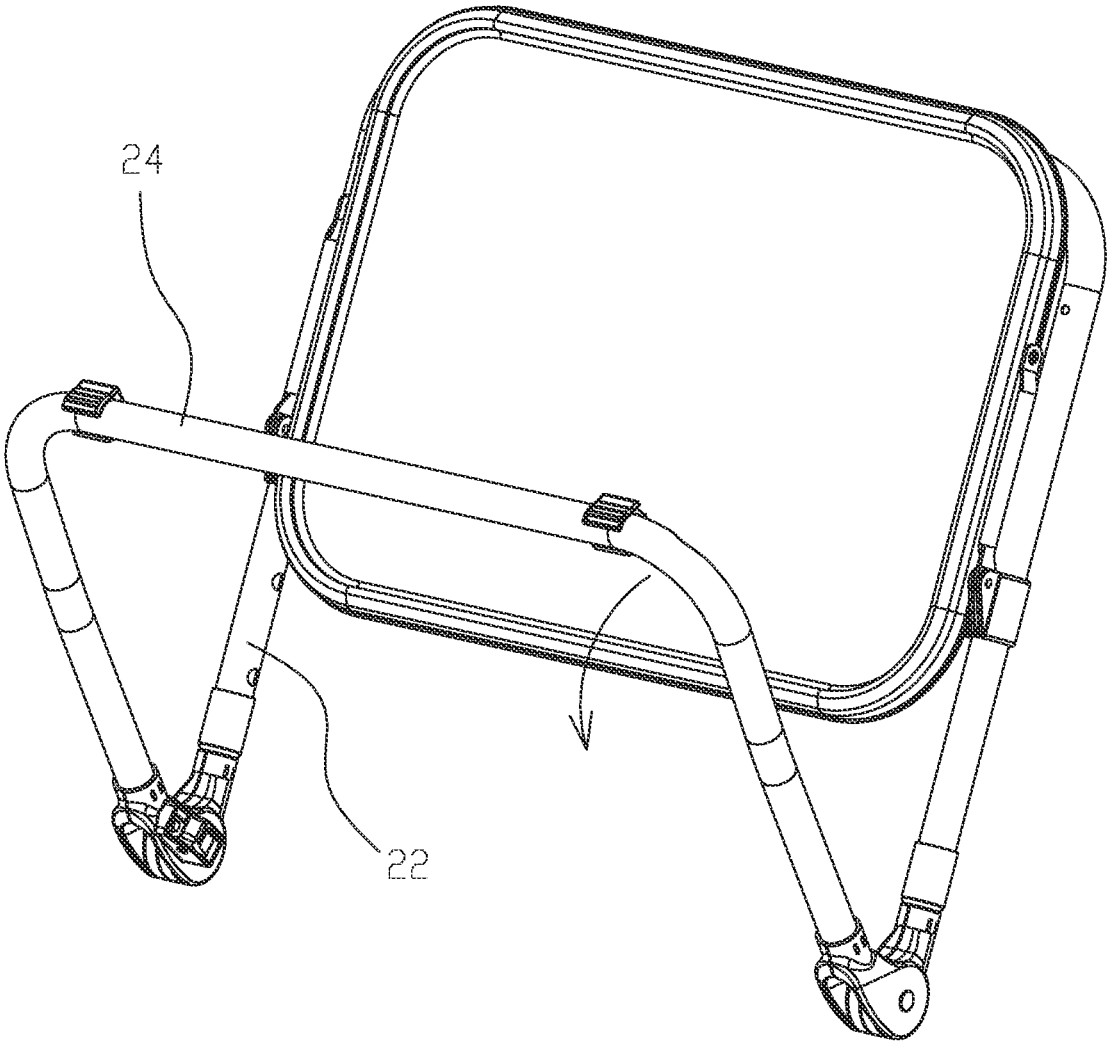
FIG. 8 illustrates a perspective view of the foldable table of Embodiment 1 in the present disclosure, when the foldable table is in an opening process.
Figure 9:
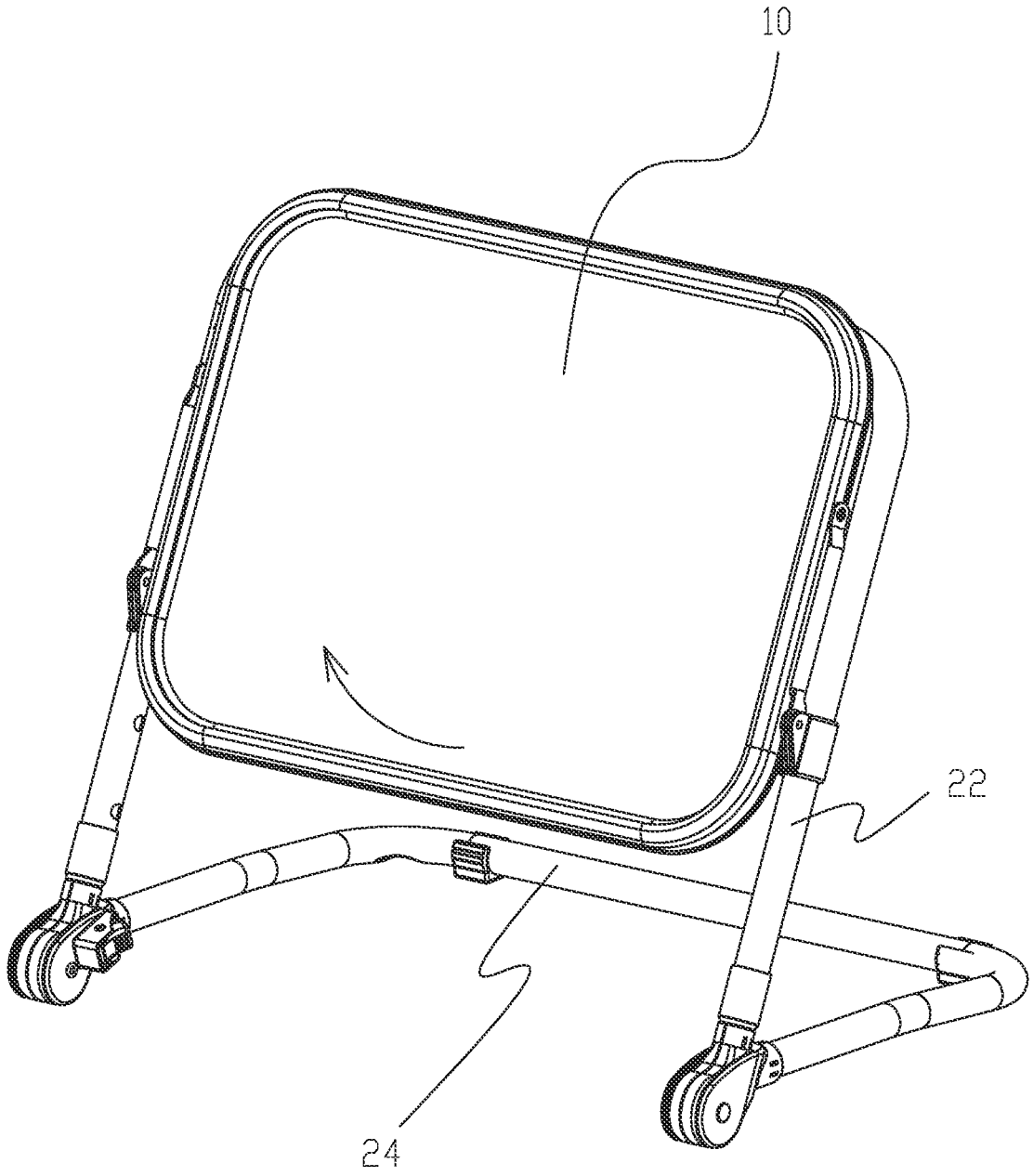
FIG. 9 illustrates a perspective view of the foldable table of Embodiment 1 in the present disclosure, when the foldable table is in the opened state.
Figure 10:
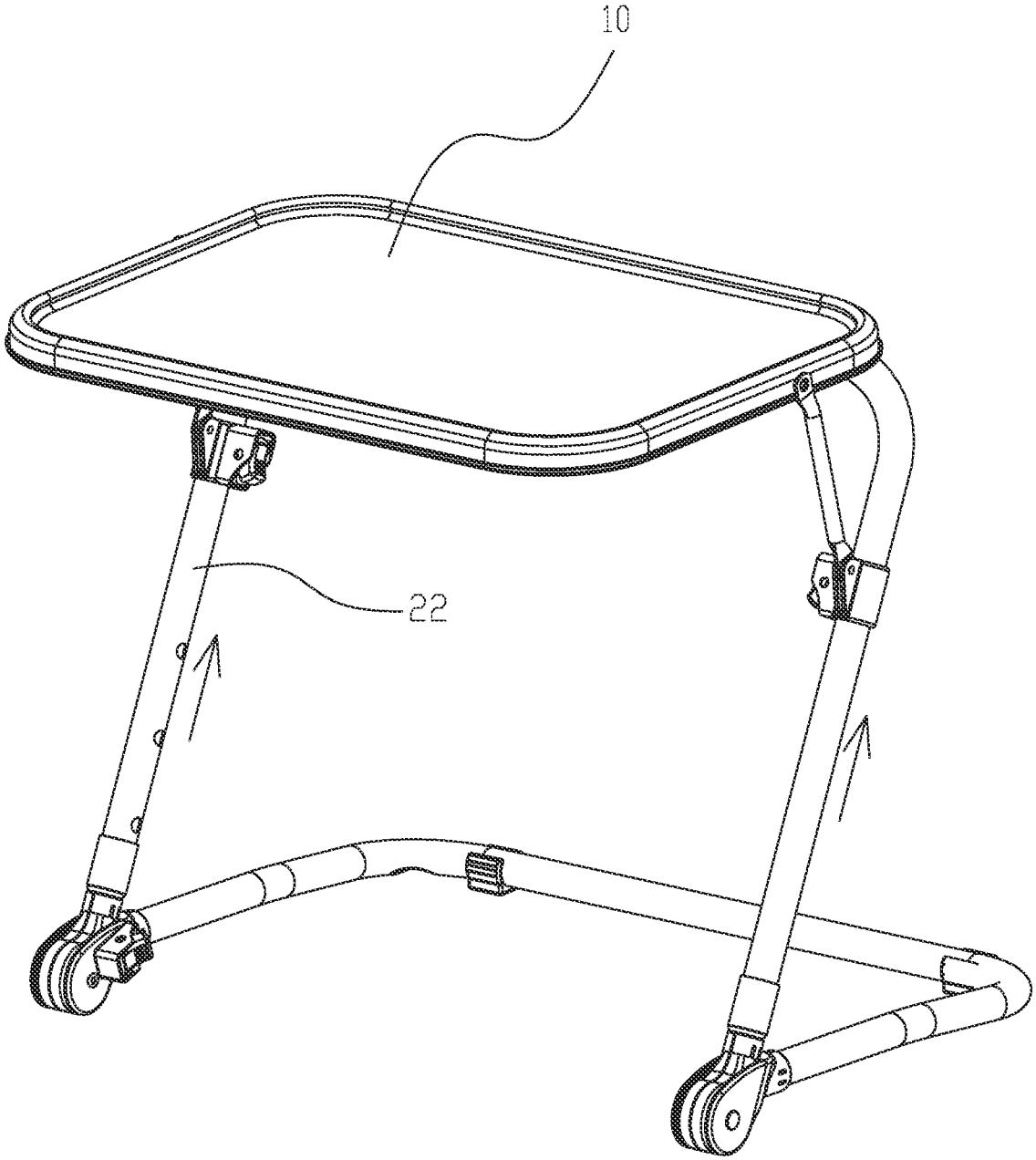
FIG. 10 illustrates a perspective view of the foldable table of Embodiment 1 in the present disclosure, when two supporting rods are in a retracted state and the foldable table is in the opened state.
Figure 11:
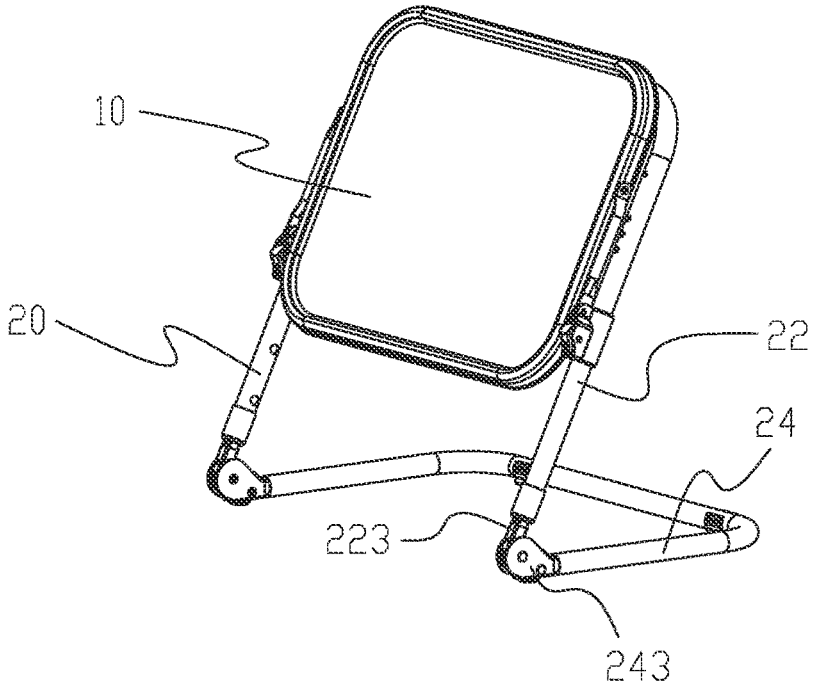
FIG. 11 illustrates a perspective view of a foldable table of Embodiment 2 in the present disclosure when a U-shaped fixed rod is opened to be in an opened state.

Preferably, when the table board 10 is in a folding process, the table board 10 is rotated downward around a connection point at which the table board 10 is connected to the foot supporting frame 20, and the table board 10 is folded on the two supporting rods 22, as shown in FIGS. 8 and 9. Correspondingly, when the table board 10 is in an opening process, a front end of the table board 10 is directly lifted. When the U-shaped fixed rod 24 is in the folding process, the U-shaped fixed rod 24 is rotated downward around a connection point at which the U-shaped fixed rod 24 is connected to the two supporting rods 22, and the U-shaped fixed rod 24 is folded on the two supporting rods 22 when the two supporting rods 22 have a longer length or on a top surface of the table board 10 when the two supporting rods 22 have a shorter length. As shown in FIGS. 7, 8, and 9, a rotation angle of the U-shaped fixed rod 24 exceeds 180 degrees. Correspondingly, when the U-shaped fixed rod 24 is in the opening process, the U-shaped fixed rod 24 is rotated downward from a front side of the two supporting rods 22 to a rear side of the two supporting rods 22.

Preferably, each of the two ends of the opening of the U-shaped fixed rod 24 is disposed with a position-limiting structure 241. When the foot supporting frame 20 is opened to be in the opened state, each of the two supporting rods 22 is obliquely disposed on the position-limiting structure 241 with respect to the ground. In addition, one or more oblique linking bars 30 are connected between the table board 10 and each of the two supporting rods 22. When the table board 10 is opened to be in the opened state, the table board 10 is supported on the one or more oblique linking bars 30.

Preferably, the position-limiting structure 241 is a U-shaped block in which an end portion of each of the two supporting rods 22 is disposed, and the end portion of each of the two supporting rods 22 is rotatably connected to the U-shaped block through a rivet.

Preferably, each of the two ends of the opening of the U-shaped fixed rod 24 is disposed with an outer plastic member 242, and the outer plastic member 242 is wrapped around the U-shaped block. A shape of the U-shaped block is similar to the outer plastic member 242. Each of the lower ends of the two supporting rods 22 is disposed with an inner plastic member 222, and the outer plastic member 242 is sleeved outside of the inner plastic member 222.

Preferably, the foldable table further comprises a table foot locking mechanism 40 connected to at least one of the outer plastic members 242, and the U-shaped fixed rod 24 is locked to the table foot locking mechanism 40 when the U-shaped fixed rod 24 is opened to be in the opened state. A structure of the table foot locking mechanism 40 can be various, such as a latch or a spring ball.

Preferably, the one or more oblique linking bars 30 are two oblique linking bars 30 respectively corresponding to the two supporting rods 22. An upper end of each of the two oblique linking bars 30 is rotatably connected to a rear portion of a side of the table board 10, and a lower end of each of the two oblique linking bars 30 is rotatably connected to a sliding sleeve 50 slidably sleeved on each of the two supporting rods 22.

Preferably, at least one of the sliding sleeves 50 is disposed with a table board locking mechanism 60, and the sliding sleeve 50 is locked to the table board locking mechanism 60 when the table board 10 is opened to be in the opened state. Likewise, a structure of the table board locking mechanism 60 can be various.

Preferably, the foldable table further comprises a cup holder 70. A side of the cup holder 70 is disposed with a C-shaped buckle 72, and the C-shaped buckle 72 is buckled to one of the two supporting rods 22.

Preferably, the upper ends of the two supporting rods 22 are connected by a cross rod 26. In some embodiments, the two supporting rods 22 and the cross rod 26 may be an integral structure, and at least one buckle member 12 is sleeved on the cross rod 26 and is connected to the bottom surface of the table board 10. That is, the cross rod 26 is locked under the table board 10 by the at least one buckle member 12, and the cross rod 26 and the table board 10 can rotate relative to each other.

Preferably, a side wall of the cup holder 70 comprises a hanging groove 74, and the at least one buckle member 12 comprises a hanging lug 121. The hanging lug 121 can be locked to the hanging groove 74.

Preferably, the two supporting rods 22 are telescopic, so that a use height of the table board 10 can be adjusted. In addition, in this embodiment, all sides of the top surface of the table board 10 comprise a circle of bosses, so that when the table board 10 is tilted for use, items do not easily slip off.

Referring to FIGS. 7-10, in this embodiment, steps of opening the foldable table are preferably: the first step is to open the U-shaped fixed rod 24, the second step is to open the table board 10, and finally the two supporting rods 22 are adjusted to extend and retract as required.

Embodiment 2

Figure 12:
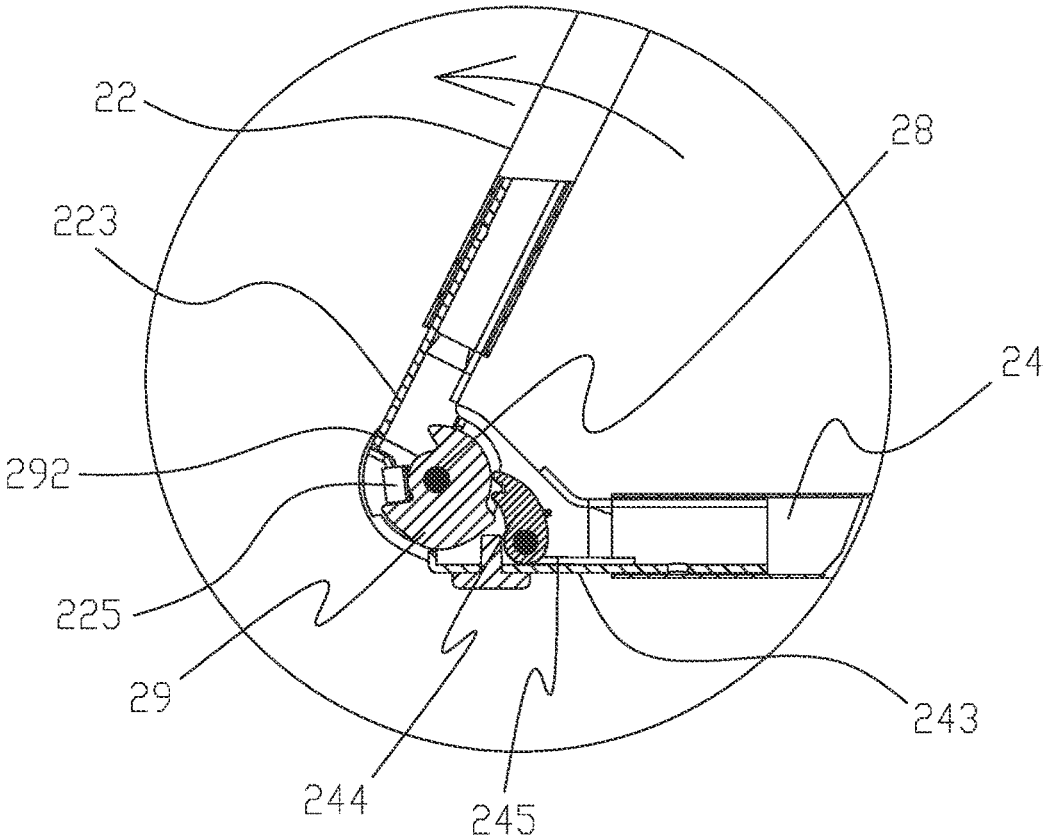
FIG. 12 illustrates a cross-sectional view of a connection position between two supporting rods and the U-shaped fixed rod of the foldable table illustrated in FIG. 11.
Figure 13:
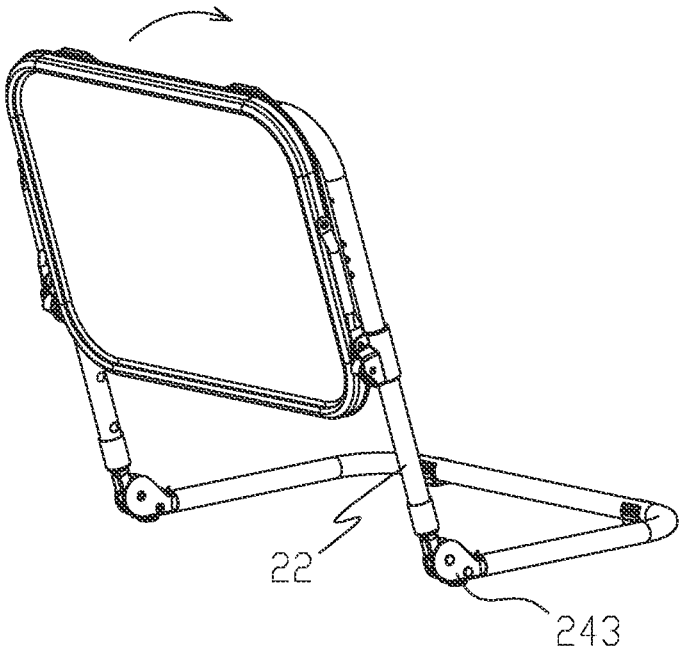
FIG. 13 illustrates a perspective view of the two supporting rods and the U-shaped fixed rod of the foldable table of Embodiment 2 in the present disclosure, when the two supporting rods and the U-shaped fixed rod are in an unlocked state.
Figure 14:
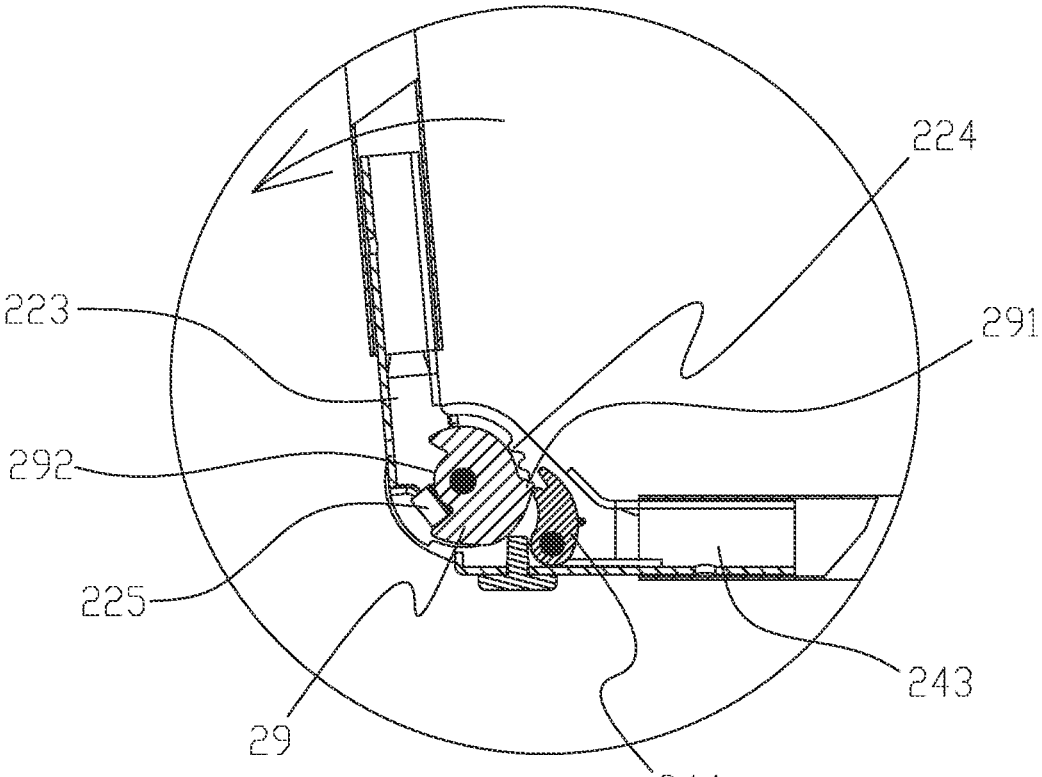
FIG. 14 illustrates a cross-sectional view of the connection position between two supporting rods and the U-shaped fixed rod of the foldable table illustrated in FIG. 13.
Figure 15:
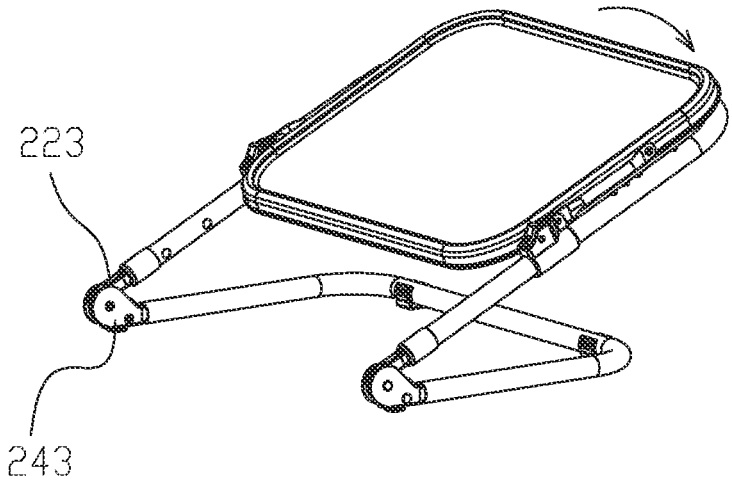
FIG. 15 illustrates a perspective view of the two supporting rods and the U-shaped fixed rod of the foldable table of Embodiment 2 in the present disclosure, when the two supporting rods and the U-shaped fixed rod are in a folding process.
Figure 16:
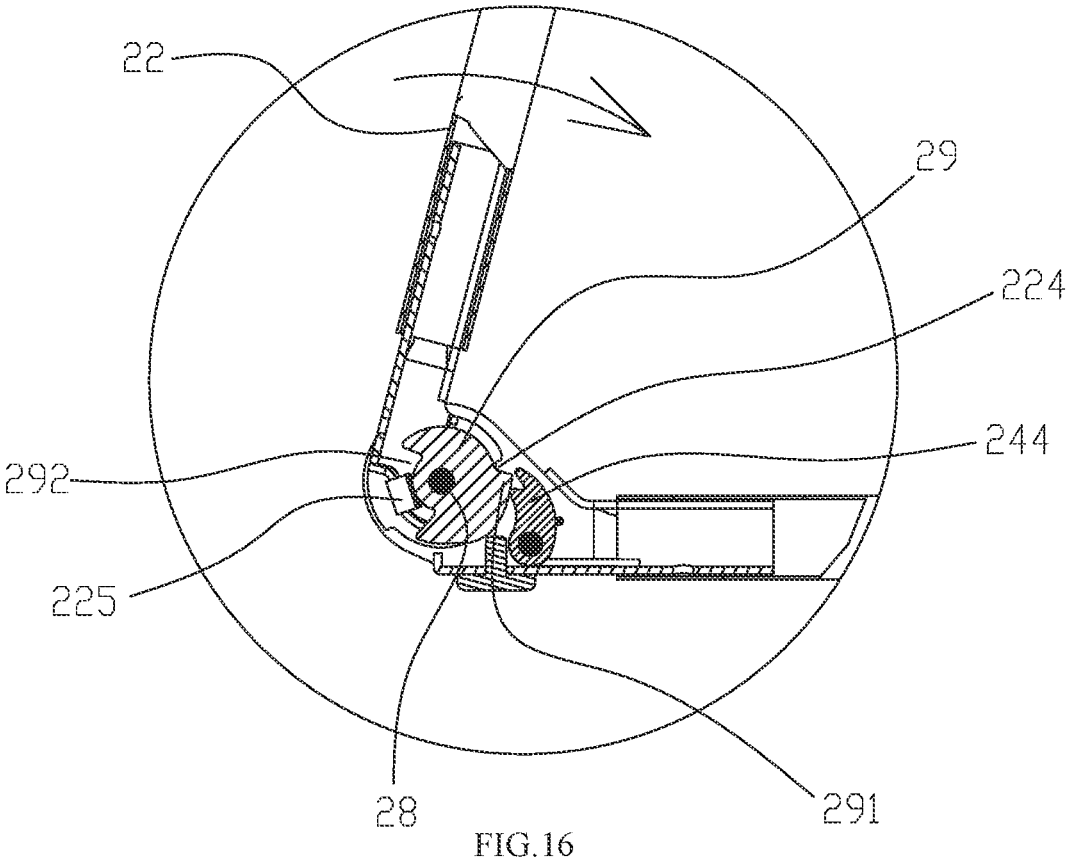
FIG. 16 illustrates a cross-sectional view of the connection position between two supporting rods and the U-shaped fixed rod of the foldable table illustrated in FIG. 15.
Figure 17:
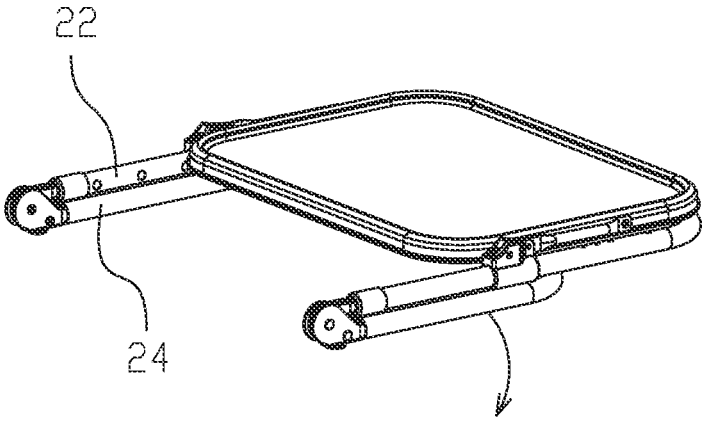
FIG. 17 illustrates a perspective view of the two supporting rods and the U-shaped fixed rod of the foldable table of Embodiment 2 in the present disclosure, when the two supporting rods and the U-shaped fixed rod are in a folded state.
Figure 18:
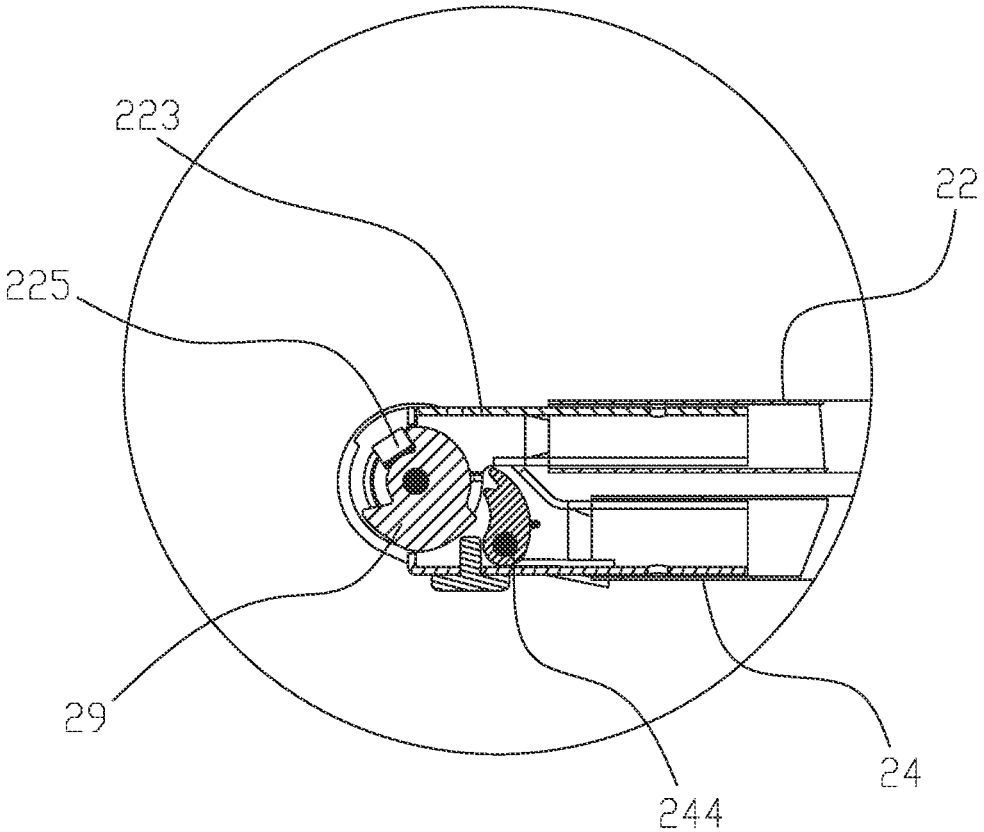
FIG. 18 illustrates a cross-sectional view of the connection position between two supporting rods and the U-shaped fixed rod of the foldable table illustrated in FIG. 17.

Referring to FIGS. 11-18, FIG. 11 and FIG. 12 are respectively a first perspective view of the foldable table and a first cross-sectional view of the foldable table illustrated in the first perspective view, FIG. 13 and FIG. 14 are respectively a second perspective view of the foldable table and a second cross-sectional view of the foldable table illustrated in the second perspective view, FIG. 15 and FIG. 16 are respectively a third perspective view of the foldable table and a third cross-sectional view of the foldable table illustrated in the third perspective view, and FIG. 17 and FIG. 18 are respectively a fourth perspective view of the foldable table and a fourth cross-sectional view of the foldable table illustrated in the fourth perspective view.

The difference between embodiment 1 and embodiment 2 is the connecting structure between each of the two supporting rods 22 and the U-shaped fixed rod 24. In Embodiment 2, the connecting structure between each of the two supporting rods 22 and the U-shaped fixed rod 24 is as described below. When the foot supporting frame 20 is in the folding process, the two supporting rods 22 are rotated rearward about the connection point at which the U-shaped fixed rod 24 is connected to the two supporting rods 22 and are folded on the U-shaped fixed rod 24. It is understandable that movement between the two supporting rods 22 and the U-shaped fixed rod 24 is relative, and a rearward rotation of the two supporting rods 22 is equivalent to a frontward rotation of the U-shaped fixed rod 24.

Preferably, each of the two ends of the opening of the U-shaped fixed rod 24 is disposed with an outer hinge 243, the lower end of each of the two supporting rods 22 is disposed with an inner hinge 223, and the outer hinge 243 and the inner hinge 223 are rotatably connected to each other through a rivet 28. An inside of the inner hinge 223 is disposed with one or more position-limiting tooth grooves 224, and an inside of the outer hinge 243 is rotatably connected with a swinging tooth 244. The inside of the outer hinge 243 is further disposed with a torsion spring 245. When the U-shaped fixed rod 24 is opened to be in the opened state, the swinging tooth 244 is inserted into the one or more position-limiting tooth grooves 224 due to an elastic force of the torsion spring 245 so that the two supporting rods 22 are locked to the U-shaped fixed rod 24. That is to say, when the U-shaped fixed rod 24 is opened to be in the opened state, the inner hinge 223 and the outer hinge 243 are locked to each other through the one or more position-limiting tooth grooves 224 and the swinging tooth 244, so that the two supporting rods 22 can be stably, obliquely placed with respect to the ground.

Preferably, the foldable table further comprises a pushing piece 29 rotatably sleeved on the rivet 28. A first side of the pushing piece 29 facing the swinging tooth 244 comprises a protrusion 291, and a second side of the pushing piece 29 facing away from the swinging tooth 244 comprises an arc-shaped position-providing groove 292. The inner hinge 223 is disposed with a pushing block 225, and the pushing block 225 is located in the arc-shaped position-providing groove 292.

When the U-shaped fixed rod 24 is in the folding process, referring to FIG. 12, the two supporting rods 22 can be rotated frontward first. When the pushing block 225 is rotated around the rivet 28 to correspond to a lower end of the arc-shaped position-providing groove 292, the pushing piece 29 is pushed to rotate together, referring to FIG. 14, so that the swinging tooth 244 is lifted by the protrusion 291 of the pushing piece 29 to be separated from the one or more position-limiting tooth grooves 224. Next, referring to FIG. 16, the two supporting rods 22 are rotated rearward, and the pushing block 225 is rotated around the rivet 28. Before the pushing block 225 is moved to correspond to an upper end of the arc-shaped position-providing groove 292, the one or more position-limiting tooth grooves 224 and the swinging tooth 244 are staggered from each other. Finally, the pushing block 225 is moved to the upper end of the arc-shaped position-providing groove 292 and drives the pushing piece 29 to rotate together, referring to in FIG. 18, until the two supporting rods 22 are folded on the U-shaped fixed rod 24. In the folding process, it can be understand that after the protrusion 291 of the pushing piece 29 is separated from the swinging tooth 244, since the one or more position-limiting tooth grooves 224 and the swinging tooth 244 have been misaligned with each other, the swinging tooth 244 can be driven by the torsion spring 245 to abut the inner hinge 223, which is still free to rotate for folding.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A foldable table, comprising:

a table board, and a foot supporting frame, wherein:

a rear portion of a bottom surface of the table board is rotatably connected to a top portion of the foot supporting frame, the foot supporting frame comprises two supporting rods disposed symmetrically on a left side and a right side of the foldable table and a U-shaped fixed rod, lower ends of the two supporting rods are respectively rotatably connected to two ends of an opening of the U-shaped fixed rod, each of the two ends of the opening of the U-shaped fixed rod is disposed with a position-limiting structure, two oblique linking bars respectively corresponding to the two supporting rods are connected between the table board and the two supporting rods, an upper end of each of the two oblique linking bars is rotatably connected to a rear portion of a side of the table board, a lower end of each of the two oblique linking bars is rotatably connected to a sliding sleeve slidably sleeved on each of the two supporting rods, when the table board and the foot supporting frame are opened to be in an opened state:

the U-shaped fixed rod is supported on ground with the opening of the U-shaped fixed rod facing forward, the two supporting rods are disposed obliquely with respect to the ground, and a side view of the folding table is Z-shaped, when the table board is in a folding process:

the table board is rotated downward around a first connection point at which the table board is connected to the foot supporting frame, and the table board is folded on the two supporting rods, when the U-shaped fixed rod is in the folding process:

the U-shaped fixed rod is rotated downward around a second connection point at which the U-shaped fixed rod is connected to the two supporting rods, and the U-shaped fixed rod is folded on the two supporting rods or on a top surface of the table board, when the foot supporting frame is opened to be in the opened state, each of the two supporting rods is obliquely disposed on the position-limiting structure with respect to the ground, and when the table board is opened to be in the opened state, the table board is supported on the two oblique linking bars.

2. The foldable table according to claim 1, wherein:

when the table board and the foot supporting frame are opened to be in the opened state, a projection surface of a top view of the table board substantially overlaps with the U-shaped fixed rod.

3. The foldable table according to claim 1, wherein:

the position-limiting structure is a U-shaped block in which an end portion of each of the two supporting rods is disposed, and the end portion of each of the two supporting rods is rotatably connected to the U-shaped block through a rivet.

4. The foldable table according to claim 3, wherein:

each of the two ends of the opening of the U-shaped fixed rod is disposed with an outer plastic member, the outer plastic member is wrapped around the U-shaped block, each of the lower ends of the two supporting rods is disposed with an inner plastic member, and the outer plastic member is sleeved outside of the inner plastic member.

5. The foldable table according to claim 4, wherein:

the foldable table further comprises a table foot locking mechanism connected to at least one of the outer plastic members, and the U-shaped fixed rod is locked to the table foot locking mechanism when the U-shaped fixed rod is opened to be in the opened state.

6. The foldable table according to claim 1, wherein:

at least one of the sliding sleeves is disposed with a table board locking mechanism, and the at least one of the sliding sleeves is locked to the table board locking mechanism when the table board is opened to be in the opened state.

7. The foldable table according to claim 1, wherein:

the foldable table further comprises a cup holder, a side of the cup holder is disposed with a C-shaped buckle, and the C-shaped buckle is buckled to one of the two supporting rods.

8. The foldable table according to claim 7, wherein:

upper ends of the two supporting rods are connected by a cross rod, the two supporting rods are telescopic, at least one buckle member is sleeved on the cross rod and is connected to the bottom surface of the table board, a side wall of the cup holder comprises a hanging groove, the at least one buckle member comprises a hanging lug, and the hanging lug is configured to be locked to the hanging groove.

9. A foldable table, comprising:

a table board, and a foot supporting frame, wherein:

a rear portion of a bottom surface of the table board is rotatably connected to a top portion of the foot supporting frame, the foot supporting frame comprises two supporting rods disposed symmetrically on a left side and a right side of the foldable table and a U-shaped fixed rod, lower ends of the two supporting rods are respectively rotatably connected to two ends of an opening of the U-shaped fixed rod, each of the two ends of the opening of the U-shaped fixed rod is disposed with an outer hinge, the lower end of each of the two supporting rods is disposed with an inner hinge, the outer hinge and the inner hinge are rotatably connected to each other through a rivet, an inside of the inner hinge is disposed with one or more position-limiting tooth grooves, an inside of the outer hinge is rotatably connected with a swinging tooth, the inside of the outer hinge is further disposed with a torsion spring, when the U-shaped fixed rod is opened to be in an opened state, the swinging tooth is disposed in the one or more position-limiting tooth grooves due to an elastic force of the torsion spring so that the two supporting rods are locked to the U-shaped fixed rod, when the table board and the foot supporting frame are opened to be in the opened state:

the U-shaped fixed rod is supported on ground with the opening of the U-shaped fixed rod facing forward, the two supporting rods are disposed obliquely with respect to the ground, and a side view of the folding table is Z-shaped, when the table board is in a folding process:

the table board is rotated downward around a first connection point at which the table board is connected to the foot supporting frame, and the table board is folded on the two supporting rods, and when the U-shaped fixed rod is in the folding process:

the two supporting rods are rotated rearward around a second connection point at which the U-shaped fixed rod is connected to the two supporting rods, and the two supporting rods are folded on the U-shaped fixed rod.

10. The foldable table according to claim 9, wherein:

the foldable table further comprises a pushing piece rotatably sleeved on the rivet, a first side of the pushing piece facing the swinging tooth comprises a protrusion, a second side of the pushing piece facing away from the swinging tooth comprises an arc-shaped position-providing groove, the inner hinge is disposed with a pushing block, the pushing block is located in the arc-shaped position-providing groove, the two supporting rods are configured to be rotated frontward to drive the pushing block to rotate about the rivet to correspond to a lower end of the arc-shaped position-providing groove to push the pushing piece to rotate together, so that the swinging tooth is pushed away from the one or more position-limiting tooth grooves, and the one or more position-limiting tooth grooves are configured to be misaligned with the swinging tooth before the two supporting rods are rotated rearward to drive the pushing block to rotate about the rivet to correspond to an upper end of the arc-shaped position-providing groove.

11. The foldable table according to claim 9, wherein:

two oblique linking bars respectively corresponding to the two supporting rods are connected between the table board and the two supporting rods, when the table board is opened to be in the opened state, the table board is supported on the two oblique linking bars, an upper end of each of the two oblique linking bars is rotatably connected to a rear portion of a side of the table board, a lower end of each of the two oblique linking bars is rotatably connected to a sliding sleeve slidably sleeved on each of the two supporting rods, at least one of the sliding sleeves is disposed with a table board locking mechanism, and the at least one of the sliding sleeves is locked to the table board locking mechanism when the table board is opened to be in the opened state.

12. A foldable table, comprising:

a table board, and a foot supporting frame, wherein:

a rear portion of a bottom surface of the table board is rotatably connected to a top portion of the foot supporting frame, the foot supporting frame comprises two supporting rods disposed symmetrically on a left side and a right side of the foldable table and a U-shaped fixed rod, lower ends of the two supporting rods are respectively rotatably connected to two ends of an opening of the U-shaped fixed rod, two oblique linking bards respectively corresponding to the two supporting rods are connected between the table board and the two supporting rods, when the table board and the foot supporting frame are opened to be in an opened state:

the U-shaped fixed rod is supported on ground with the opening of the U-shaped fixed rod facing forward, the two supporting rods are disposed obliquely with respect to the ground, and a side view of the folding table is Z-shaped, when the table board is in a folding process:

the table board is rotated downward around a first connection point at which the table board is connected to the foot supporting frame, and the table board is folded on the two supporting rods, when the U-shaped fixed rod is in the folding process:

the two supporting rods are rotated rearward around a second connection point at which the U-shaped fixed rod is connected to the two supporting rods, and the two supporting rods are folded on the U-shaped fixed rod, when the table board is opened to be in the opened state, the table board is supported on the two oblique linking bars, an upper end of each of the two oblique linking bars is rotatably connected to a rear portion of a side of the table board, a lower end of each of the two oblique linking bars is rotatably connected to a sliding sleeve slidably sleeved on each of the two supporting rods, at least one of the sliding sleeves is disposed with a table board locking mechanism, and the at least one of the sliding sleeves is locked to the table board locking mechanism when the table board is opened to be in the opened state.

* * * * *